US006600446B2

(12) United States Patent
Moch

(10) Patent No.: US 6,600,446 B2
(45) Date of Patent: Jul. 29, 2003

(54) CASCADABLE ARCHITECTURE FOR DIGITAL BEAMFORMER

(75) Inventor: Thomas A. Moch, Owego, NY (US)

(73) Assignee: Lockheed Martin Corporation, Owego, NY (US)

( * ) Notice: Subject to any disclaimer, the term of this patent is extended or adjusted under 35 U.S.C. 154(b) by 0 days.

(21) Appl. No.: 10/085,210

(22) Filed: Feb. 27, 2002

(65) Prior Publication Data

US 2003/0011516 A1 Jan. 16, 2003

Related U.S. Application Data

(60) Provisional application No. 60/302,121, filed on Jun. 29, 2001.

(51) Int. Cl.[7] ..... H01Q 3/26
(52) U.S. Cl. ..... 342/373
(58) Field of Search ..... 342/373, 372, 342/368, 157

(56) References Cited

U.S. PATENT DOCUMENTS

| | | | | |
|---|---|---|---|---|
| 4,577,193 A | 3/1986 | Kiuchi et al. | ..... | 343/380 |
| 5,016,018 A | 5/1991 | Chang et al. | ..... | 342/351 |
| 5,274,386 A | 12/1993 | Pellon | ..... | 342/380 |
| 5,510,799 A | 4/1996 | Wishart | ..... | 342/373 |
| 5,532,700 A | 7/1996 | Lockwood | ..... | 342/378 |
| 5,541,607 A | 7/1996 | Reinhardt | ..... | 342/372 |
| 5,572,216 A | 11/1996 | Weinberg et al. | ..... | 342/357 |
| 5,630,154 A | 5/1997 | Bolstad et al. | ..... | 395/800 |
| 5,817,024 A | 10/1998 | Ogle et al. | ..... | 600/447 |
| 5,940,742 A | 8/1999 | Dent | ..... | 445/31.3 |
| 5,961,461 A | 10/1999 | Mo et al. | ..... | 600/443 |
| 6,031,485 A | 2/2000 | Cellai et al. | ..... | 342/131 |
| 6,188,915 B1 | 2/2001 | Martin et al. | ..... | 455/562 |
| 6,377,213 B1 * | 4/2002 | Odachi et al. | ..... | 342/383 |

FOREIGN PATENT DOCUMENTS

| | | | | |
|---|---|---|---|---|
| EP | 0 963 003 A2 | 8/1999 | ..... | H01Q/3/26 |
| EP | 1 041 730 A1 | 4/2000 | ..... | H04B/1/707 |
| WO | WO 01/31812 A1 | 3/2001 | ..... | H04B/7/08 |

OTHER PUBLICATIONS

R. P. Gooch, B. J. Sublett, "A Multimode Adaptive Beamformer for Quadrature Amplitude Modulated Signals", IEEE 1988 Intl Conf. on Acoustics, Speech, and Signal Processing, Apr. 11–14, 1988.

M. D. Zoltowski, A. S. Gecan, "Advanced Adaptive Null Steering Concepts for GPS", MILCOM '95, Nov. 8, 1995.

U.S. patent application Ser. No. 60/302,121, Moch filed Jun. 29, 2001.

* cited by examiner

*Primary Examiner*—Theodore M. Blum
(74) *Attorney, Agent, or Firm*—Perkins, Smith & Cohen LLP; Jacob N. Erlich; Orlando Lopez

(57) ABSTRACT

A cascadable beamformer with the capability to cooperate with one or more cascadable beamformers to build a customized beamforming apparatus. The architecture supports a cascadable beamformer with a covariance estimate logic that supports cascading multiple devices together to support different numbers of input channels, a weighted sum logic that supports cascading multiple devices together to support different numbers of input channels, and a weighted sum logic that supports cascading multiple devices together to support different numbers of output beams.

10 Claims, 9 Drawing Sheets

CASCADABLE ARCHITECTURE FOR DIGITAL BEAMFORMER

CROSS REFERENCE TO RELATED APPLICATIONS

This application claims priority of U.S. Provisional Application No. 60/302,121 filed on Jun. 29, 2001, which is herein incorporated by reference.

BACKGROUND OF THE INVENTION

This invention relates generally to the modification of a receiver antenna pattern, and, more particularly to hardware architecture for digital beamforming that is cascadable and used as a common building block in the customization of beamforming systems.

The basis for controlling antenna patterns through the use of beamforming is well known. The primary function of a digital beamformer is to create an output that is a weighted sum of the input channels. By doing this, it is possible to accentuate certain types of signals present in the input channels, while at the same time reducing or "nulling" other undesirable signals as long as the signals arrive at the antenna from different directions. The beamformer receives signals at several spatially separated antennas. By controlling the weighting coefficients, an effective antenna pattern is produced which has nulls in the direction of the source of undesirable signals and a main lobe in the direction of a source of a desired signal.

As previously stated, beamforming is a process by which received signals from several different antenna elements are combined in a way that accentuates desired signals and attenuates, or reduces, undesirable signals. The method of combination involves, in general, applying an amplitude scaling and phase shift to the received signal from each antenna element, and summing these results together. This combination of signals from the antenna elements results in an effective antenna "pattern." The effect of this antenna pattern is to enhance or reduce radio frequency (RF) signals arriving at the antenna array depending on the angle of arrival (AOA) of the RF signal.

The weighting coefficients for the digital beamformer must be calculated dynamically in order to properly direct the antenna pattern nulls. If the direction of the nulls and main lobe is known, the weighting coefficients could be directly calculated. However, the direction of the source of undesirable signals is typically not known. Because of this, a method is used to determine the beamformer coefficients, which is based on a covariance estimate of the input channel data. This covariance matrix is post-processed and the desired direction of the main lobe is applied. The final result is a set of beamformer coefficients. A different set of beamformer coefficients may be determined for each desired direction of the main lobe.

The weighting coefficients must also be calculated often. In the case where relative positions change rapidly, or the platform on which the digital beamformer resides is maneuvering, the directions in which to point the antenna pattern nulls and main lobe may change quickly.

Traditionally, a beamformer is custom designed to meet the specifications of a particular customer system. The beamformer includes a variable number of input channels, a variable number of output, a covariance estimator, first-in-first-out (FIFO) buffers, a weighted sum calculator, and a processor interface. Basically, no two beamformers are exactly the same because no to customers have exactly the same specifications. Therefore, each beamformer development program is unique making it costly and time consuming.

There is a wide range of potential applications from small to large. A small application may require only two input channels and one output beam. A large application may require 8 input channels and 8 output beams. The cost of the beamformer is directly proportional of the "number of gates" contained in the device. Though one large device could be used for a small application by the non-use of input channels and/or output beams, the device may be 4 to 8 times the cost of a device that is specifically designed for the smaller application. Since smaller applications tend to be more cost sensitive, the cost may be prohibitive. Also, a large device requires more power that impacts costs and potentially imposes thermal limitations to the system components. Conversely, a small beamformers currently available are not scalable up to the large application specifications.

SUMMARY OF THE INVENTION

The present invention comprises a modular beamformer architecture made up of three primary features. The first is the creation of a data ring where data samples are circulated so that a covariance matrix may be calculated on all data pairs. The second is the ability to cascade multiple devices so that partial weighted sums may be accumulated in successive devices. The third is the ability to add multiple devices whose weighted sum calculation logic work independently but on the same input data so that different antenna patterns may be realized.

These features enable processes to be performed in "real time" as the RF signal arrives. Any pause in processing may result in lost data. The calculation of beamformer coefficients from the covariance matrix may be done offline by a microprocessor or digital signal processor.

An architecture for a digital beamformer is described which allows it to be broken down into smaller building blocks. These building blocks can then be connected in different ways to support different numbers of input channels and output beams.

For a better understanding of the present invention, reference is made to the accompanying drawings and detailed description and its scope will be pointed out in the appended claims.

DETAILED DESCRIPTION OF THE PREFERRED EMBODIMENTS

Figure 1:
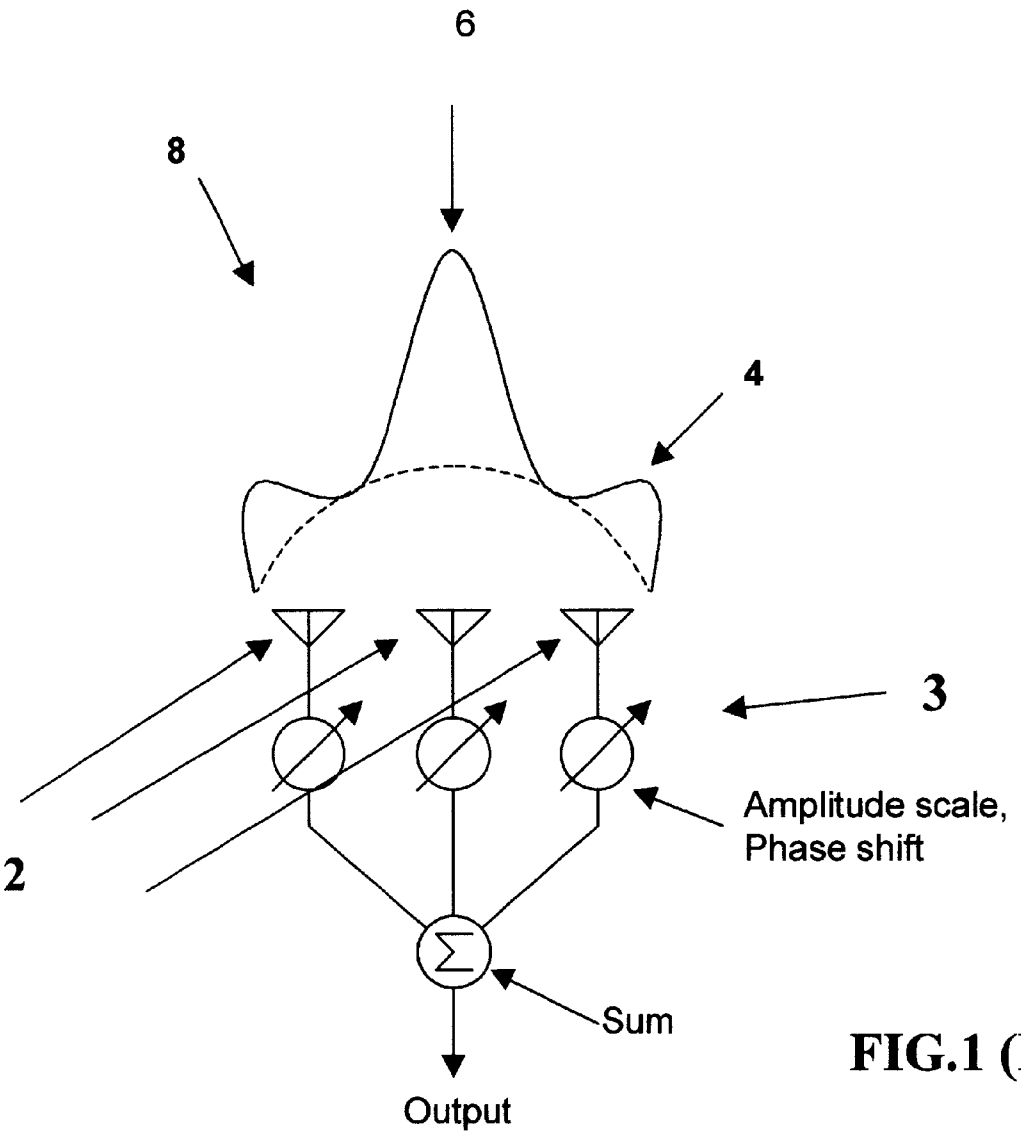
FIG.1 (PRIOR ART)
FIG. 1 is a schematic illustration of a conventional antenna pattern for a three element antenna array.
Figure 2:
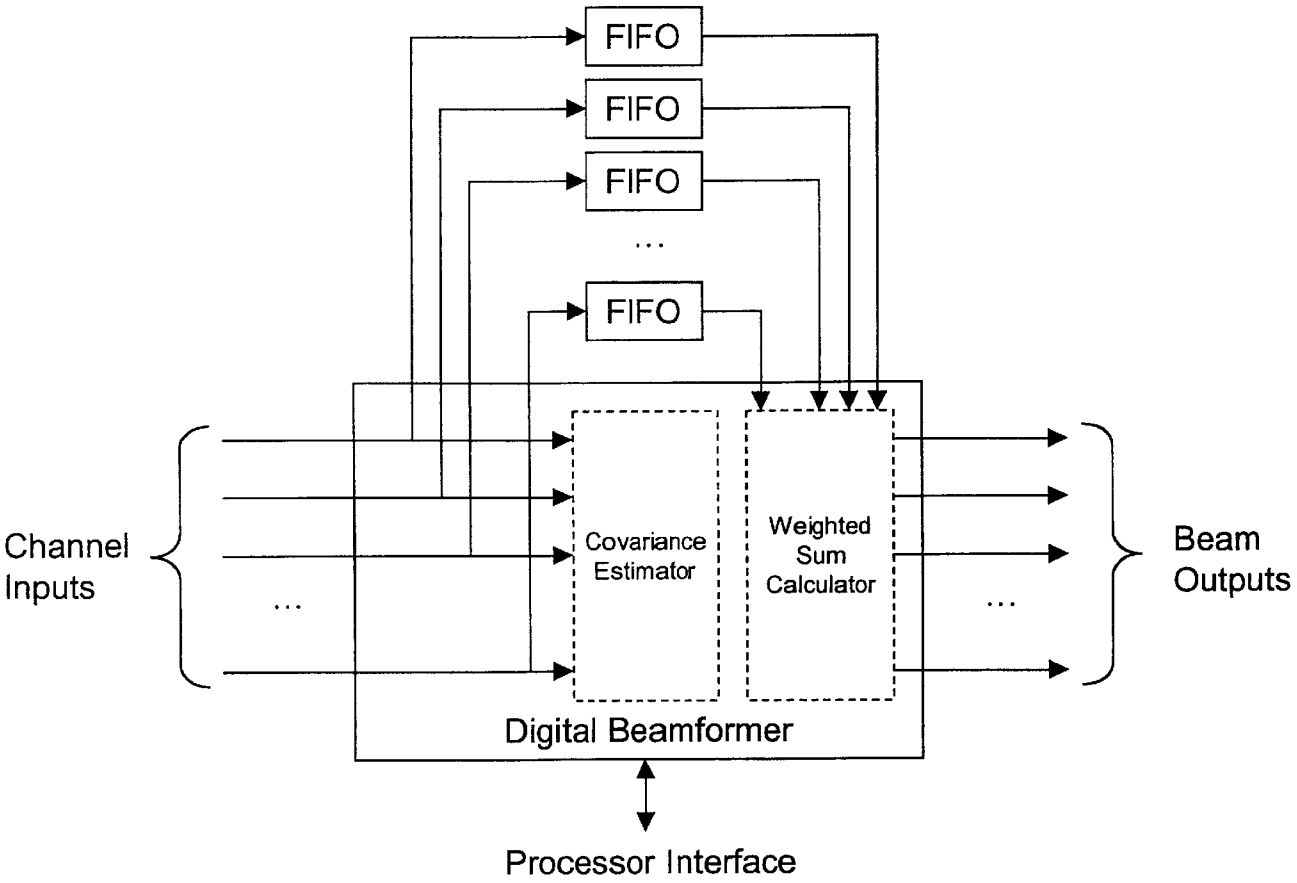
PRIOR ART FIG. 2
FIG. 2 is a functional block diagram of a prior art digital beamformer.

The present invention incorporates of a series of features that facilitate the distribution of required processing of a digital beamformer across multiple building blocks. Referring now to the embodiment of the above invention illustrated in the accompanying drawings, reference is first made to FIGS. 1 and 2 that illustrate a sample antenna pattern for a three-element antenna array 2 and a conventional beamformer, respectively. The antenna array 2 has a characteristic antenna pattern 4 given by the physical characteristics of the antenna array and the electrical characteristics of the beamforming system 3. Due to the characteristics of the antenna pattern 4, signals arriving from a direction 6, in which the antenna pattern 4 exhibits a lobe, will be enhanced, while signals arriving from a direction 8, in which the antenna pattern exhibits a trough, will the reduced.

Figure 3:
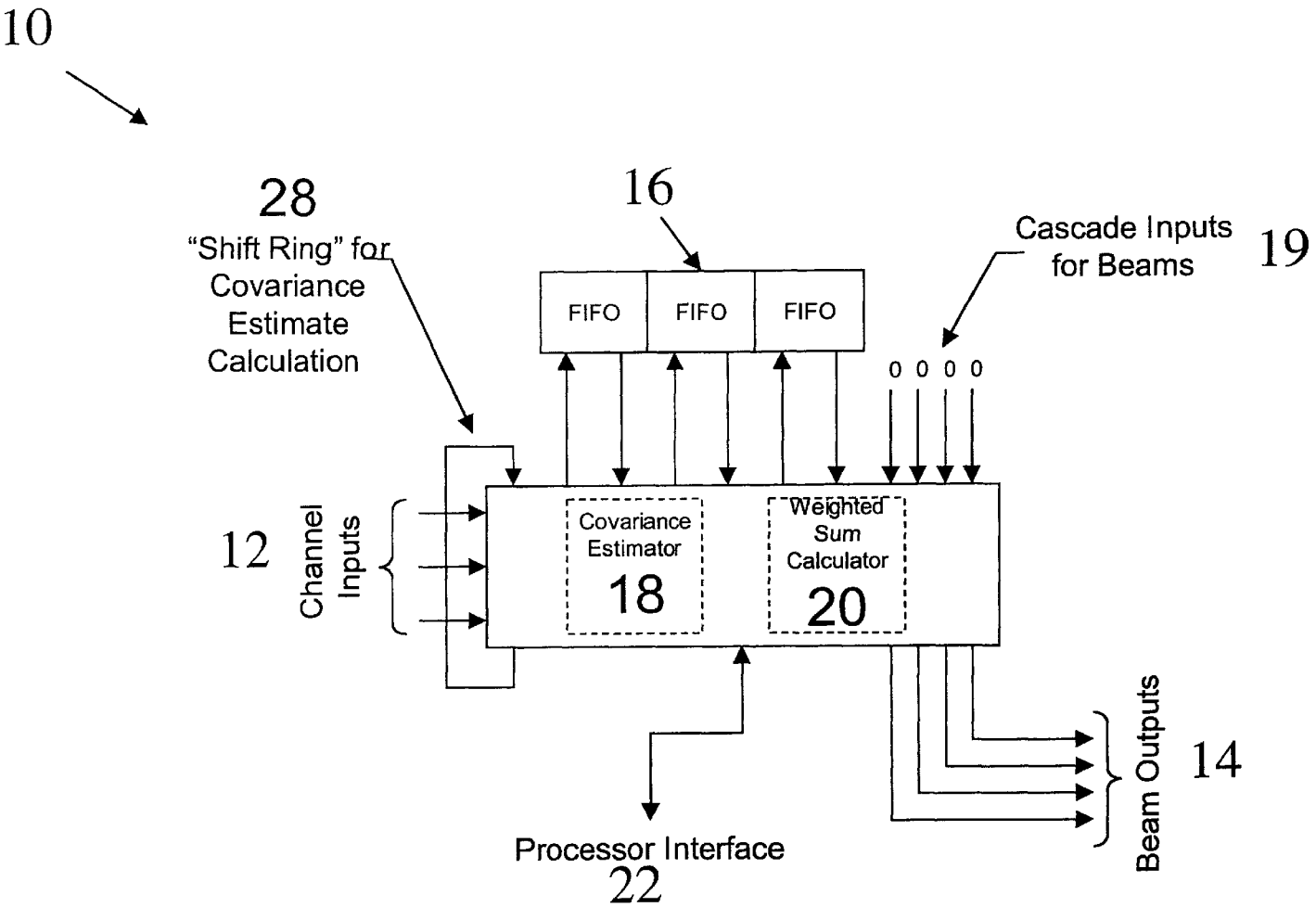
FIG. 3 shows a block diagram of the cascadable architecture for digital beamformer constructed in accordance with the present invention.

There is illustrated in FIG. 3 a block diagram of the cascadable modular architecture for digital beamformer constructed in accordance with this invention, it being generally indicated by numerical designation 10. The beamformer module 10 includes a variable number of input channels 12, a variable number of output beams 14, first-in-first out (FIFO) buffers 16, a covariance estimator 18, a weighted sum calculator 20, cascade input beams 19, shift ring 28, and a processor interface 22. (Hereinafter, each beamformer moule will be referred to as a beamformer device.) Different output beams 14 are used to support different antenna pattern main lobe directions. The number of input channels 12 is not related to the number of beam outputs 14.

The first of the features of this invention is a configuration of the covariance estimate logic that supports cascading multiple devices together to support different numbers of channel inputs 12. A covariance matrix estimate must be calculated from a frame of input channel data in real time. The method used in the described digital beamformer is to create time "frames" during which the directions to the subject signals is assumed to be constant. Then a covariance estimate is calculated for the data in this frame. From this, beamformer coefficients are determined, then the data frame is processed through a weighted sum operation using these beamformer coefficients.

The frame of input channel data may be delayed so that beamformer coefficients calculated from its covariance estimate may be applied to this same frame of data. This delay may require a significant amount of data storage, which is represented by a set of first-in-first-out (FIFO) buffers 16. (Hereinafter, a first-in-first-out buffer will be referred to as a FIFO.)

In order to use the beamformer effectively, the angle of arrival (AOA) of the undesirable signals is determined so the appropriate phase shift to the antenna elements is applied to null the undesirable signals arriving from this AOA. The use of a covariance estimate determines the phase shift directly, thereby eliminating the step of determining the AOA.

Figure 4:
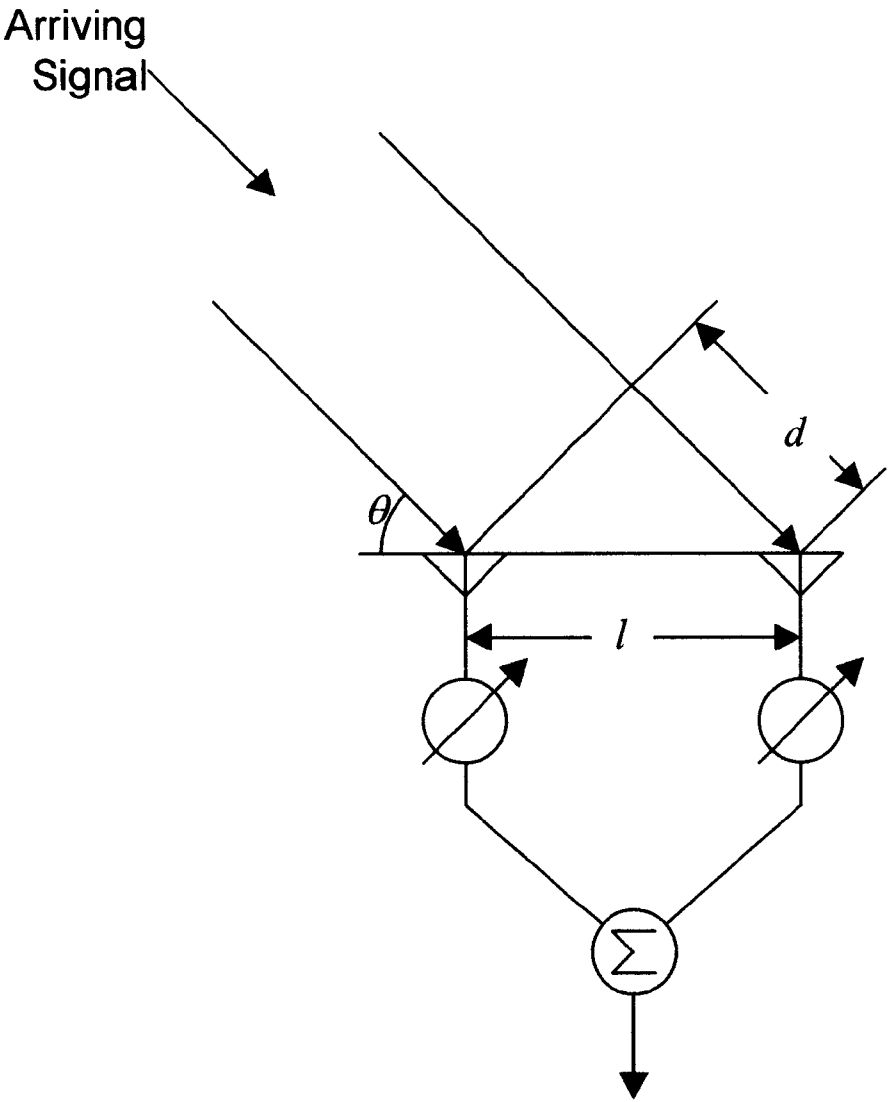
FIG. 4 (PRIOR ART)
FIG. 4 is a schematic illustration of a conventional two element RF antenna.

Consider a two element antenna array, as illustrated in FIG. 4. The two elements are separated by a distance 1. A sinusoidal RF signal is arriving at the antenna from a direction θ. The signal has a wavelength λ.

The arriving signal has to travel an extra distance d before arriving a the second antenna element. This distance is:

$$d = l \cos \theta$$

This distance is some portion of a wavelength λ of the arriving signal. The phase difference ϕ of the signal at the second antenna element relative to the first is:

$$\varphi = 2\pi \frac{d}{\lambda}$$

In other words, if d equals λ the phase difference is one complete cycle, and the signal looks identical at both elements. Finally, the expression for phase difference ϕ as a function of angle θ of arrival is:

$$\varphi = 2\pi \frac{l\cos\theta}{\lambda}$$

Now, using this information, signals are enhanced by constructively combining the received signals from the two elements, thereby reducing or "nulling" the undesirable signals. Constructive combination involves phase shifting the signal from the second element by −ϕ so that the two signals are identical. Adding the two signals will effectively double the amplitude. Destructive combination involves phase shifting the signal from the second element by π−ϕ. Now the second signal is out of phase with the first by 180°, so that when the two signals are added yielding a zero or null result.

For the purposes of beamforming, phase shifts are performed by multiplying one signal by a complex valued coefficient with unity magnitude. In general, an amplitude factor may also be applied, so that the beamformer coefficients may be any arbitrary complex value.

The covariance estimate involves taking a dot product or "sum of products" of data from all pairs of antenna elements. Let the vector $x_i$ be the vector of received data from the i-th antenna element. The vector is made up of N data values, and would look like:

$$x_i = \begin{bmatrix} x_i(0) \\ x_i(1) \\ x_i(2) \\ \cdots \\ x_i(N-1) \end{bmatrix}$$

The i, j-th element of the covariance matrix is:

$$R_{ij} = x_i^H x_j$$

Where H denotes "Hermitian transpose" or complex conjugate transpose. The magnitude of an element of the covariance matrix is effectively the "degree of match" of the two received signals, while the phase of the element is the phase shift of the signals.

Using the covariance estimate, there are many ways to determine optimum beamformer coefficients. One algorithm is known as power minimization. A derivation can be found in M. D. Zoltowski and A. S. Gecan, "Advanced Adaptive Null Steering Concepts for GPS", MILCOM 95 Conference Record, pp. 1214–1218. The result is:

$$w_{opt} = \frac{1}{\delta_1^T R^{-1} \delta_1} R^{-1} \delta_1$$

Where $w_{opt}$ is the set of optimal beamformer coefficients, $R^{-1}$ is the inverse of the covariance matrix, and $$\delta_1 = \begin{bmatrix} 1 \\ 0 \\ 0 \\ \cdots \\ 0 \end{bmatrix}$$

In addition to the basic power minimization algorithm, another algorithm is known as constrained power minimization. This algorithm works in a similar fashion to the power minimization algorithm, but allows for a "constraint" which requires that signals arriving from some specified direction not be degraded.

Figure 5:
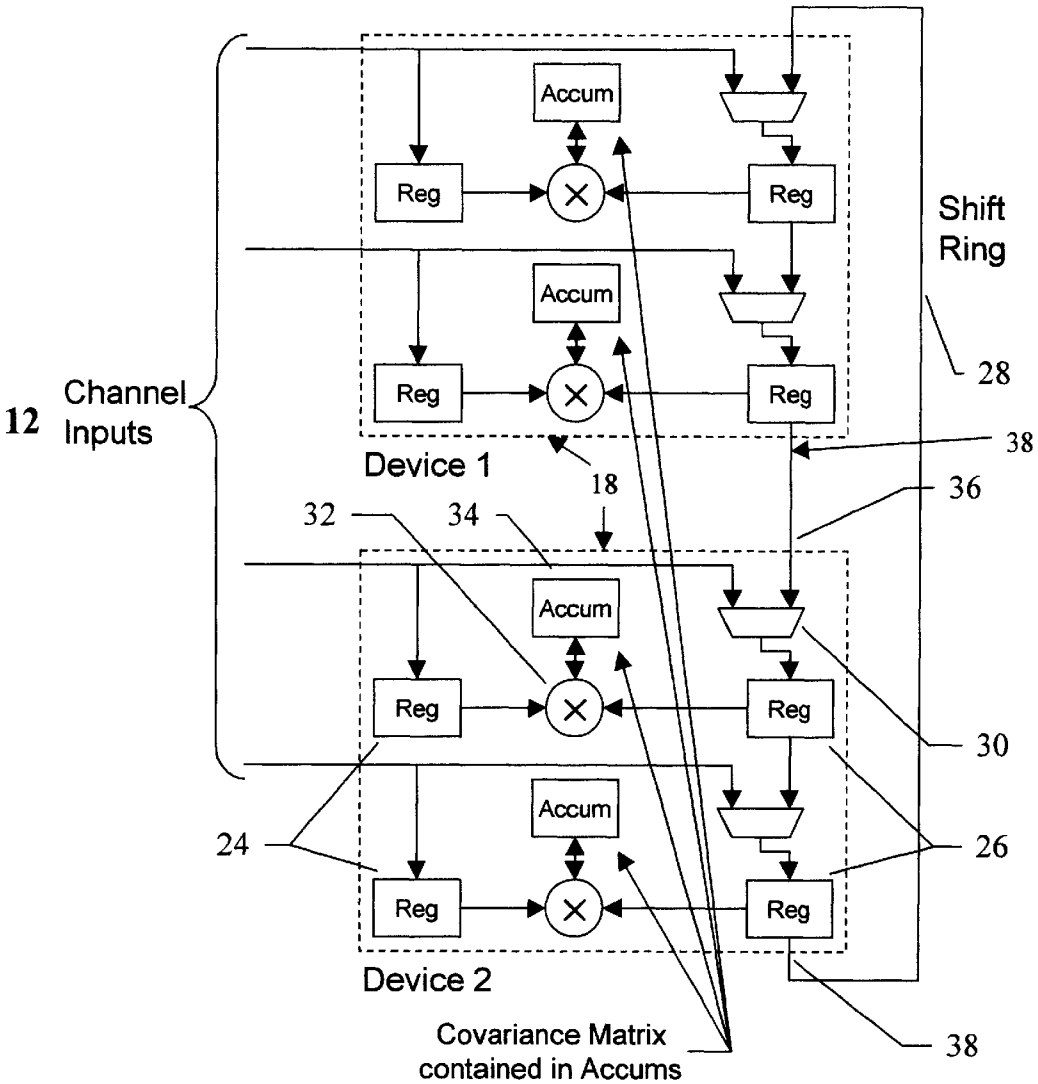
FIG. 5 schematically shows how the calculation of an estimate of the covariance matrix may be spread across multiple small building blocks in accordance with the present invention.

The operation of the logic within the covariance estimator 18 that calculates the covariance matrix is illustrated in FIG. 5. Each time that a periodic snapshot of data is required, the data is sampled into two sets of registers 24 and 26. Then during the processing phase, one of these register 24 sets is held stationary, while the second 26 circulates its data in a shift ring 28 using the alternate input of a multiplexer 30 which provides the register with its input data. Each time that a shift occurs in the shift ring 28, a new set of data pairs may be multiplied in the multipliers 32, and their results accumulated in the accumulators 34. Each accumulator 34 has N locations so that at each shift, a different accumulator 34 location is used. In this fashion, a complete row of the matrix is calculated at each shift. After N shifts, the shift ring has circulated the data back to its original position, and a complete matrix column is contained in each multiple location accumulator.

In order to make the covariance calculation logic cascadeable across multiple beamformer devices, each device has a shift ring input 36 and a shift ring output 38. The shift ring output 38 of one device is connected to the shift ring input 36 of the next device, and the shift ring output 38 of the last device is connected to the shift ring input 36 of the first device. If only one device is used, its shift ring output 38 is connected to its shift ring input 36. Using these ports, the entire data snapshot is able to circulate through all devices.

Figure 6:
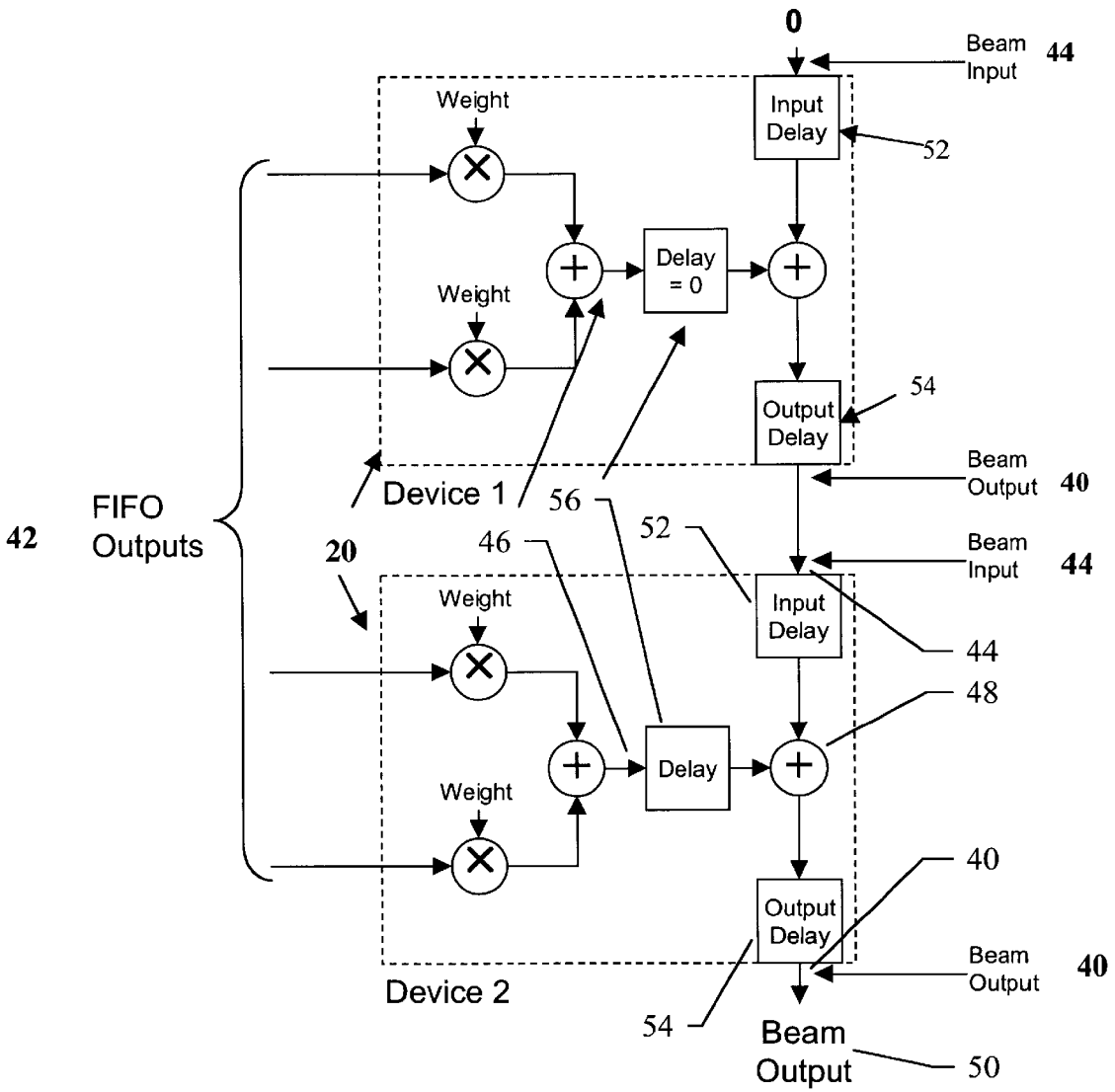
FIG. 6 schematically shows how the calculation of a weighted sum may be spread across multiple small building blocks in accordance with the present invention.

Referring now to FIG. 6, the next key feature of the present invention is a configuration of the weighted sum logic which supports cascading multiple beamformer devices together to support different numbers of channel inputs. The weighted sum calculator 20 that produces the output beam 40 uses the delayed FIFO outputs 42. Each set of samples coming from the FIFO is multiplied by a set of weights. (beamformer coefficients) and summed together to produce one output beam 40 sample.

In order to make the weighted sum operation cascadeable across multiple devices, the weighted sum calculator 20 of each beamformer device has a beam input 44 and a beam output 40. Each weighted sum calculator 20 calculates a partial weighted sum of its own input channels 46, and an adders 48 adds this sum to the value presented on the beam input 44. This result is passed to the beam output 40. The beam input 44 of the weighted sum calculator of one device, Device 1, is hard wired to a value of 0. The beam output 40 of the weighted sum calculator of each device is connected to the beam input 44 of the weighted sum calculator of the next device. In this way, the partial weighted sum is passed from weighted sum calculator to weighted sum calculator, accumulating the partial weighted sum of additional channels along the way. The beam output 40 of the last weighted sum calculator is the final beam output 50 that is the weighted sum of all channel data.

Propagation of the partial weighted sum from weighted sum calculator to weighted sum calculator will necessarily incur some input delay 52 and output delay 54. Because of this delay, each weighted sum calculator does its partial sum in two parts. The first part is to calculate the partial weighted sum of all its channels 46. Then, this partial weighted sum is delayed 56 until the previous weighted sum calculator is able to present its output. For the first weighted sum calculator, Device 1, since its beam input is always 0, the delay is set to zero. The delay of the second weighted sum calculator is equal to the time that it takes to get the partial weighted sum out of the first weighted sum calculator and into the second. A third weighted sum calculator would have a delay that is twice as long.

Figure 7:
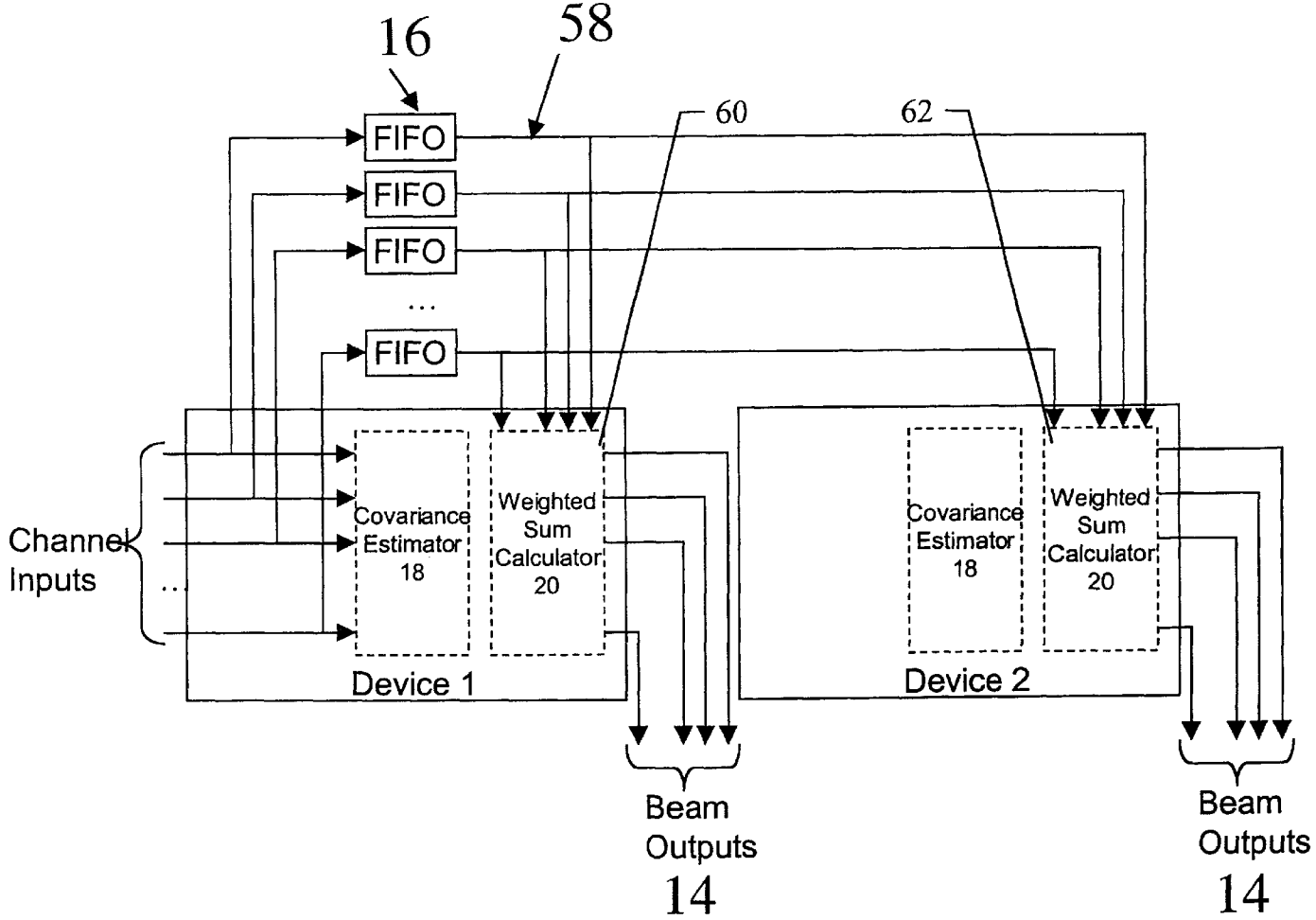
FIG. 7 is a block diagram showing how multiple building blocks may be combined to produce additional beam outputs in accordance with the present invention.

Referring now to FIG. 7, the final key feature of the present invention is a configuration of the weighted sum logic which supports cascading multiple beamformer devices together to support different numbers of beam outputs. In one embodiment of the present invention, the two main portions of the digital beamformer device (the covariance estimator 18 and the weighted sum calculator 20) are de-coupled at the external FIFO 16. Because of this, multiple beams 14 may be supported by routing the FIFO outputs 58 into multiple devices 60 and 62, each of which is capable of performing independent weighted sum operations. In this configuration, the covariance estimator 18 of device 2 is not used.

Figure 8:
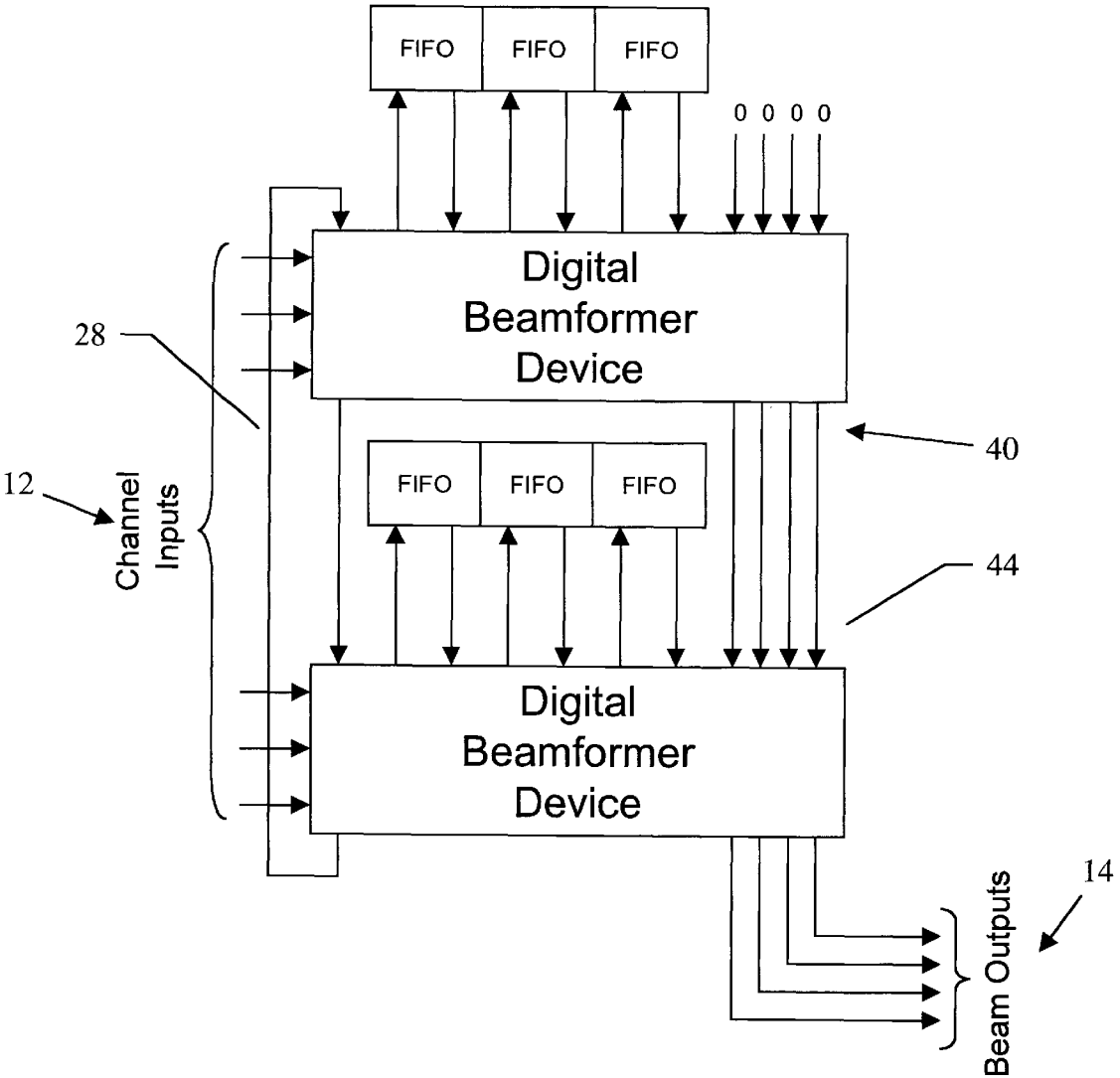
FIG. 8 is a block diagram showing how the present invention extends the single building block configuration for the digital beamformer by adding an additional building block to allow for more input channels.

FIG. 8 shows how two devices may be cascaded to be able to handle additional input channels 12. In this case, the shift ring 28 is opened up to include both devices, and the beam outputs 40 of the first device are fed to the beam inputs 44 of the second device.

Figure 9:
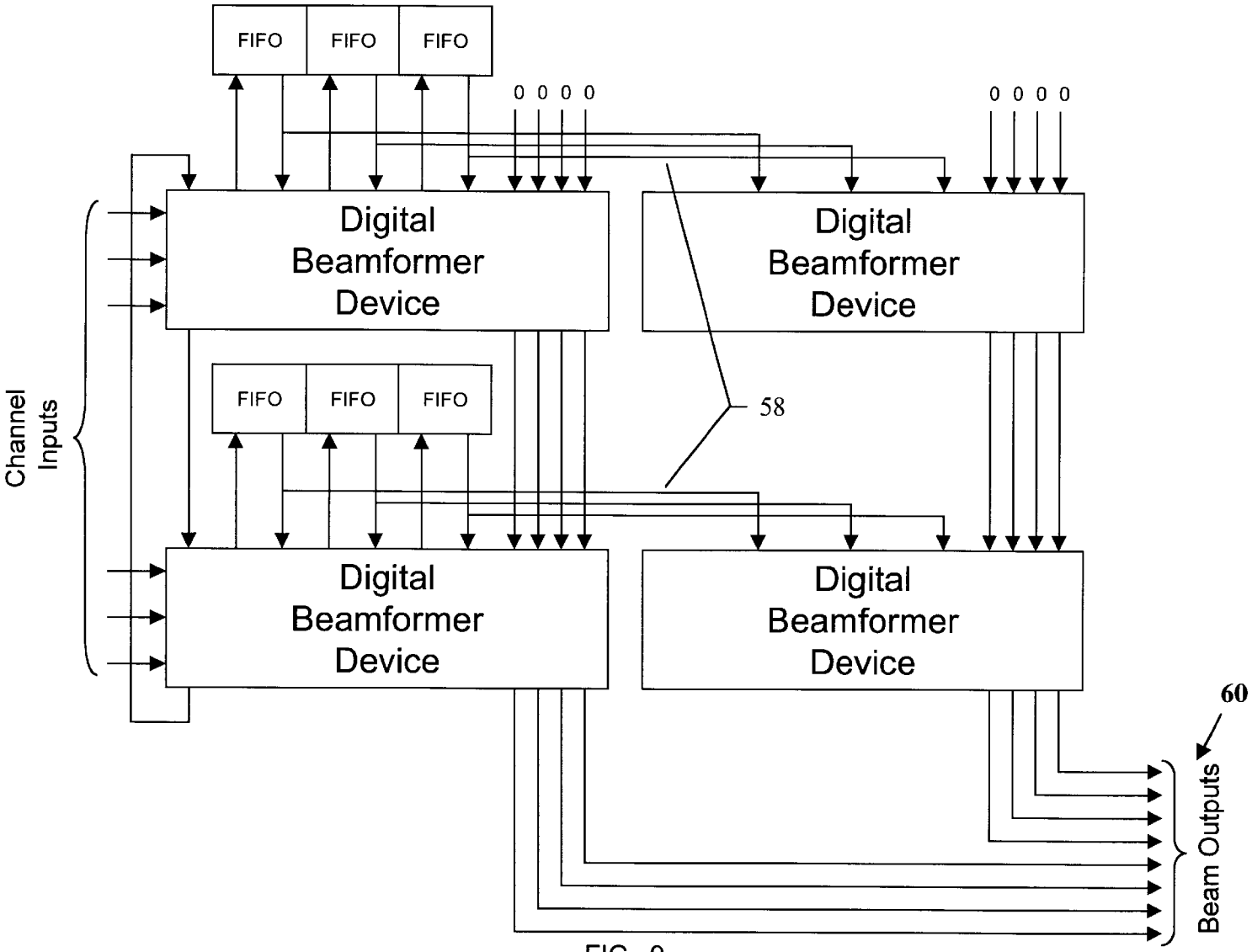
FIG. 9 is a block diagram showing how the present invention further extends the configuration for the digital beamformer by adding two additional building blocks to allow more output beams to be formed.

FIG. 9 shows more devices cascaded so additional output beams 60 are formed. These additional devices receive data into their weighted sum logic from the FIFO outputs 58 of the original devices. The covariance estimation logic of these additional devices is not used.

Although the invention has been described with respect to various embodiments, it should be realized this invention is also capable of a wide variety of further and other embodiments within the spirit and scope of the invention.

What is claimed is:

1. A beamformer, which receives channel input data in a given number of input data channels, said beamformer comprising:

at least one module, said module receiving cascaded beam inputs and a subset of the channel input data and said at least one module comprising;

a covariance estimator, said covariance estimator being cascadable across at least another module, said covariance estimator including a covariance estimator output, whereby cascading said covariance estimator across said at least another module enables obtaining another beamformer receiving input data channels different from said number of input data channels;

an interface to a processor;

a plurality of buffers providing delayed channel input data; and a weighted sum calculator, said weighted sum calculator being cascadable with at least another module, wherein beamformer coefficients and the delayed channel input data are processed through the weighted sum calculator to produce output beam data in a given number of output beam channels, said beamformer coefficients being determined from the output of the covariance estimator, whereby cascading said weighted sum calculator with said at least another module enables obtaining still another beamformer producing output beam channels different from said number of output beam channels.

2. The beamformer of claim 1 wherein said covariance estimator comprises:

a shift ring, said shift ring including a shift ring input and a shift ring output; and two sets of registers into which data is sampled, one of said sets having its data held stationary while data in the second of said sets circulates in said shift ring;

a set of multipliers; and a set of accumulators, each accumulator of said set of accumulators having a plurality of locations, wherein, when a shift occurs in said shift ring, a set of data pairs is multiplied in said multipliers yielding a result, said result being accumulated in accumulators.

3. The beamformer of claim 1 wherein said weighted sum calculator accepts beam input data, said beam input data enabling said weighted sum calculator to accept a partial sum input, said output beam data enabling the providing of a partial sum to another module.

4. The beamformer of claim 2 wherein said weighted sum calculator accepts beam input data, said beam input data enabling said weighted sum calculator to accept a partial sum input, said output beam data enabling the providing of a partial sum to another module.

5. The beamformer of claim 1 wherein said beamformer coefficients are obtained using a power minimization algorithm.

6. The beamformer of claim 1 wherein said beamformer coefficients are obtained using a constrained power minimization algorithm.

7. A covariance estimator comprising:

a shift ring, said shift ring including a shift ring input and a shift ring output;

two sets of registers into which data is sampled, one said set having its data held stationary while data in the second set circulates in said shift ring;

a set of multipliers; and a set of accumulators, each accumulator of said set of accumulators having a plurality of locations, wherein, when a shift occurs in said shift ring, a set of data pairs is multiplied in said multipliers yielding a result, said result being accumulated in accumulators.

8. A method of cascading a plurality of beamformer modules in order to accept additional input channels, said channels providing channel input data, each module receiving cascaded beam inputs and a subset of said input channel data and each module comprising beam outputs and a shift ring including a shift ring input and a shift ring output, said method comprising the steps of:

opening the shift ring by connecting the shift ring output of a preceding module to the shift ring input of a succeeding module and connecting the shift ring output of the last of said plurality of modules to the shift ring input of a first of said plurality of modules;

providing a null state input to each beam input of the first of said plurality of modules; and connecting the beam outputs of the preceding module to the beam inputs of the succeeding module.

9. A method of cascading a plurality of beamformer modules in order to obtain a given number of output channels, each of said beamformer modules capable of receiving channel input data and each of said beamformer modules comprising a covariance estimator, a plurality of buffers providing delayed channel input data and a weighted sum calculator, the delayed input data being processed through the weighted sum calculator to produce output beam data, said method comprising the steps of:

(A) providing the delayed input data from a first of said plurality of beamformer modules to the weighted sum calculator of said first of said plurality of beamformer modules;

(B) processing the delayed input data being through said weighted sum calculator to produce a first number of output beam data channels;

(C) providing the delayed input data from said first of said plurality of beamformer modules to the weighted sum calculator of each subsequent one of said plurality of beamformer modules; and, (D) processing the delayed input through the weighted sum calculator of each subsequent one of said plurality of beamformer modules to produce another number of output beam data channels at each subsequent one of said plurality of beamformer modules, a summation of the number of output beam data channels from said plurality of beamformer modules being the given number of output channels.

10. The method of claim 9 further comprising, in order to accept additional input channels utilizing at least two cascaded pluralities of said beamformer modules, the steps of:

repeating, at least once, steps (A) through (D) in order to obtain at least two cascaded pluralities of beamformer modules, each of said beamformer modules capable of receiving cascaded beam inputs, and a first one of each of said at least two cascaded pluralities of beamformer modules receiving a subset of said input channel data and comprising a shift ring including a shift ring input and a shift ring output;

opening the shift ring by connecting the shift ring output of a first module of a preceding cascaded plurality of said beamformer modules to the shift ring input of a first module of a succeeding plurality of said beamformer modules; and connecting the shift ring output of a first module of the last of said pluralities of said beamformer modules to the shift ring input of a first module of said first plurality of said beamformer modules;

providing a null state input to each beam input of each module in the first of said cascaded pluralities of said beamformer modules; and connecting the beam outputs of each module of the preceding cascaded plurality of said beamformer modules to the beam inputs of each module of the succeeding cascaded plurality of said beamformer modules.

* * * * *